US012710183B2

(12) United States Patent
Luo et al.

(10) Patent No.: US 12,710,183 B2
(45) Date of Patent: Aug. 18, 2026

(54) HOUSING ASSEMBLY, AIR-CONDITIONER OUTDOOR UNIT, AND AIR-CONDITIONING APPARATUS

(71) Applicants: GD Midea Heating & Ventilating Equipment Co., Ltd., Foshan (CN); Midea Group Co., Ltd., Foshan (CN)

(72) Inventors: Weihong Luo, Foshan (CN); Shengsheng Liao, Foshan (CN); Mingren Wang, Foshan (CN); Tiegang Zhang, Foshan (CN); Tao Zhang, Foshan (CN); Weijie Yuan, Foshan (CN)

(73) Assignees: GD MIDEA HEATING & VENTILATING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 383 days.

(21) Appl. No.: 17/992,821

(22) Filed: Nov. 22, 2022

(65) Prior Publication Data

US 2023/0078988 A1 Mar. 16, 2023

Related U.S. Application Data

(63) Continuation of application No. PCT/CN2021/118452, filed on Sep. 15, 2021.

(30) Foreign Application Priority Data

Nov. 24, 2020 (CN) ..... 202022743527.7

(51) Int. Cl.
*F24F 1/56* (2011.01)
*F24F 1/16* (2011.01)

(52) U.S. Cl.
CPC ..... *F24F 1/56* (2013.01); *F24F 1/16* (2013.01)

(58) Field of Classification Search
CPC ..... F24F 1/56; F24F 1/16; F24F 13/20; F24F 2013/202
See application file for complete search history.

(56) References Cited

U.S. PATENT DOCUMENTS 6,435,632 B1 * 8/2002 Correa ..... F24F 13/20 312/265.5
2011/0005257 A1 * 1/2011 Crow ..... F24F 1/022 165/45

FOREIGN PATENT DOCUMENTS

CN 204987285 U 1/2016
CN 206205351 U 5/2017
(Continued)

OTHER PUBLICATIONS

Midea Group Co., Ltd., ISR, PCT/CN2021/118452, Dec. 23, 2021, 7 pgs.

(Continued)

*Primary Examiner* — Tavia Sullens
(74) *Attorney, Agent, or Firm* — Morgan, Lewis & Bockius LLP

(57) ABSTRACT

A housing assembly includes a panel having a plurality of sub-panels including a first sub-panel and at least one second sub-panel, the first sub-panel being fitted with an electric control box of an air-conditioner outdoor for shielding the electric control box. According to the housing assembly provided in the present disclosure, when an electric control box is to be maintained, only the first sub-panel is removed to expose the electric control box, without removing two panels to expose the electric control box, thereby reducing the difficulty of electric control maintenance and improving the convenience of electric control maintenance.

13 Claims, 7 Drawing Sheets

(56) References Cited

FOREIGN PATENT DOCUMENTS

| | | | | | |
|---|---|---|---|---|---|
| CN | 206618047 | U | * | 11/2017 | |
| CN | 208154663 | U | | 11/2018 | |
| CN | 109341040 | A | * | 2/2019 | ..... F24F 1/22 |
| CN | 210511943 | U | | 5/2020 | |
| CN | 211781859 | U | | 10/2020 | |
| CN | 213577800 | U | | 6/2021 | |
| JP | 2010019533 | A | | 1/2010 | |
| JP | 2013204836 | A | * | 10/2013 | |
| JP | 2013217566 | A | | 10/2013 | |

OTHER PUBLICATIONS

Midea Group Co., Ltd., Extended European Search Report and Supplementary Search Report, EP21896488.0, Oct. 19, 2023, 9 pgs.
Midea Group Co., Ltd., WO, PCT/CN2021/118452, Dec. 23, 2021, 5 pgs.
Midea Group Co., Ltd., IPRP, PCT/CN2021/118452, May 30, 2023, 6 pgs.
GD Midea Heating & Ventilating Equipment Co., Ltd et al., India Office Action, IN Patent Application No. 202247063217, Oct. 3, 2025, 5 pgs.
GD Midea Heating & Ventilating Equipment Co., Ltd et al., India Office Action, IN Patent Application No. 202247063217, Jan. 16, 2026, 2 pgs.

* cited by examiner

HOUSING ASSEMBLY, AIR-CONDITIONER OUTDOOR UNIT, AND AIR-CONDITIONING APPARATUS

RELATED APPLICATIONS

This application is a continuation of PCT Patent Application No. PCT/CN2021/118452, filed Sep. 15, 2021, which claims priority to Chinese Patent Application No. 202022743527.7, filed Nov. 24, 2020, and the entire contents of which are all herein incorporated by reference.

FIELD

The present disclosure relates to the field of air-conditioning apparatus, and particularly to a housing assembly, an air-conditioner outdoor unit, and an air-conditioning apparatus.

BACKGROUND

In the current technology, as shown in FIG. 1, a panel of an air-conditioner outdoor unit is generally designed to have upper and lower panels, i.e., an upper panel 21' and a lower panel 22'. An electric control box is mounted close to the middle of a height of a body of the unit, and both panels are to be disassembled when the electric control box needs repair, which is inconvenient.

SUMMARY

According to some embodiments of the present disclosure, a housing assembly is provided for use with an air-conditioner outdoor unit, the housing assembly including a panel, the panel including a plurality of sub-panels, the plurality of sub-panels including a first sub-panel and at least one second sub-panel, the first sub-panel being adapted to an electric control box of the air-conditioner outdoor unit for shielding the electric control box.

In some embodiments, the housing assembly includes the panel, the panel including the first sub-panel. In some embodiments, the first sub-panel is adapted to the electric control box of the air-conditioner outdoor unit, it may be necessary to remove the first sub-panel to expose the electric control box and repair the electric control box, without having to remove two panels to expose the electric control box. Therefore, the electric control maintenance may be less difficult and facilitated.

Furthermore, compared with providing a large-area panel to shield the electric control box and other components, separately providing the first sub-panel adapted to the electric control box at a position corresponding to the electric control box may be advantageous in reducing the size of the first sub-panel, and may reduce the weight of the first sub-panel. Moreover, an operator may be facilitated in disassembling and mounting the first sub-panel for the electric control maintenance. Therefore, the electric control maintenance may be much less difficult and may be further facilitated.

According to an embodiment of the present disclosure, the housing assembly includes a shell, the panel being detachably connected to the shell, one of the second sub-panel and the shell being provided with a catch, and the other being provided with a plughole, and the catch being in plug-in engagement with the plughole. Herein, the catch includes a connecting portion connected to the second sub-panel or the shell, a first hooking portion bent from and connected to the connecting portion and passing through the plughole, and a second hooking portion bent from and connected to the connecting portion and passing through the plughole; the second hooking portion is bent in a direction opposite the first hooking portion.

The housing assembly includes a shell, components such as the electric control box and a heat exchanger are mounted inside the shell, and the panel is detachably connected to the shell to shield the components such as the electric control box and the heat exchanger inside the shell to ensure the integrity of the appearance of the air-conditioner outdoor unit. One of the second sub-panel and the shell is provided with the catch, and the other is provided with the plughole. That is, the second sub-panel is provided with the catch, and the shell is provided with the plughole; alternatively, the second sub-panel is provided with the plughole, and the shell is provided with the catch. In the assembling process, the catch is plugged into the plughole to enable a hooked connection between the second sub-panel and the shell, so that the second sub-panel is properly positioned to render a good alignment between the second sub-panel and the shell. In this way, the second sub-panel is prevented from randomly moving relative to the shell, and the assembling of fasteners such as screws in the subsequent assembling process is facilitated; accordingly, the assembling process of the second sub-panel is less difficult, and the air-conditioner outdoor unit can be assembled more efficiently. In some embodiments, the catch includes the connecting portion, the first hooking portion, and the second hooking portion. In some embodiments, the catch is provided on the second sub-panel, the connecting portion is connected to the second sub-panel to enable a connection between the catch and the second sub-panel. In some embodiments, where the catch is provided on the shell, the connecting portion is connected to the shell to enable a connection between the catch and the shell. The first hooking portion is bent from and connected to the connecting portion to form a hook structure so that the hooked connection between the second sub-panel and the shell is enabled by the hook structure. The second hooking portion is bent from and connected to the connecting portion, and the second hooking portion is bent in the direction opposite the first hooking portion to form another hook structure, through which the hooked connection between the second sub-panel and the shell can further be enabled. Since the two hook structures are in opposite directions, the hooked connection between the second sub-panel and the shell may be enabled by either the first hooking portion or the second hooking portion. Therefore, the assembling process of the second sub-panel may be less difficult, which may be conducive to a more efficient assembling process of the product.

Furthermore, the number of the connecting portion may be one or more. For example, if the number of the connecting portion is one, the catch is of a T-shaped structure; if the number of the connecting portion is two, so that the catch includes two L-shaped structures in opposite directions.

In some embodiments, the first hooking portion and the second hooking portion are structurally the same, and the first hooking portion and the second hooking portion are arranged on both sides of the connecting portion in mirror symmetry.

The first hooking portion and the second hooking portion are structurally the same, and the first hooking portion and the second hooking portion may be arranged on both sides of the connecting portion in mirror symmetry, may provide the catch with a relatively regular structure that is easy to be processed and shaped. Moreover, since the sub-panel is generally of a symmetrical structure, the above configuration may make it possible even though inverted by 180°, the second sub-panel can still be assembled with and positioned properly in relation to the shell through the plug-in engagement between the catch and the plughole. Therefore, it may be more convenient to select a proper direction in which the second sub-panel is assembled according to a position of the second sub-panel, and may be conducive to improving the versatility of the second sub-panel.

In some embodiments, a mounting cavity is provided in the shell, the mounting cavity has an open end, the open end of the mounting cavity includes a first opening and a second opening, the first opening corresponds to the electric control box, and the second sub-panel is adapted to the second opening; the number of the second opening is plural, the number of the second sub-panel is plural, and a plurality of the second sub-panels correspond to a plurality of the second openings one to one; the first sub-panel and the plurality of second sub-panels are arranged along a height of the shell, and either side of the first sub-panel is provided with at least one second sub-panel.

In some embodiments, one end of the mounting cavity of the shell is open, so that components such as the heat exchanger and the electric control box may be conveniently and quickly mounted inside the shell through the open end of the mounting cavity, and then the panel is mounted to cover the open end of the mounting cavity, whereby the integrity of the appearance of the air-conditioner outdoor unit may be ensured. The open end of the mounting cavity includes the first opening and the second opening. Accordingly, the panel includes the first sub-panel and at least one second sub-panel. The first opening corresponds to the electric control box, and thus the first sub-panel is adapted to the first opening of the mounting cavity and can cover the first opening of the mounting cavity to shield the electric control box. The second sub-panel is adapted to cover the second opening of the mounting cavity so that an opening elsewhere of the mounting cavity may be covered, thereby may ensure that the panel covers the open end of the mounting cavity. In a particular case where the electric control box is to be repaired, it may be necessary to remove only the first sub-panel, without a need to remove the second sub-panel. Therefore, the operation may be facilitated and less difficult for an operator, and may be s more convenient to perform the electric control maintenance. Moreover, the configuration of the second opening and the second sub-panel may further facilitate the maintenance of the heat exchanger or other components.

Herein, the number of the second openings is plural, and accordingly, the number of the second sub-panels is plural; the plurality of the second sub-panels correspond to the plurality of the second openings one to one to ensure that each second opening can be covered. Moreover, the first sub-panel and the plurality of second sub-panels are arranged along the height (i.e., an up-down direction) of the shell, and either side of the first sub-panel is provided with at least one second sub-panel, that is, the first sub-panel is located at a position closer to the middle of the panel. As featured in an air-conditioner outdoor unit, the heat exchanger is generally placed near a lower end of the body of the unit and the electric control box is placed around the middle. Therefore, a position closer to the middle of the first sub-panel corresponds to a position of the electric control box of the air-conditioner outdoor unit, and the internal structure of the shell may be designed conventionally, thereby may save the cost of molding for the housing assembly.

In some embodiments, the mounting cavity is provided with a third opening opposite the open end of the mounting cavity, and the housing assembly further includes a back panel detachably connected to the shell for opening or closing the third opening.

The mounting cavity is provided with the third opening, and the third opening is opposite the open end of the mounting cavity, that is, the open end of the mounting cavity is located at the front of the shell, and the third opening is located at the back of the shell. Accordingly, the housing assembly further includes the back panel, where the back panel may be detachably connected to the shell and covers the third opening and may ensure the integrity of the appearance of the air-conditioner outdoor unit. In addition, the back panel may be e removed for an overhaul on the components near a rear portion in the shell, hence the maintenance of the air-conditioner outdoor unit may be less difficult and facilitated.

In some embodiments, the back panel is structurally identical to the second sub-panel.

The back panel is structurally identical to the second sub-panel, that is, the back panel and the second sub-panel are the same components and are in common use, may effectively improve the versatility of the components. This may make it possible to reduce the number of new molds for components and then save on the cost of molding.

In some embodiments, the first sub-panel is provided with a collar at the top, the second sub-panel above and adjacent to the first sub-panel is denoted as a top sub-panel, the top sub-panel is provided with a slot at the bottom, and the collar is in plug-in engagement with the slot.

The first sub-panel is provided with the collar at the top, and the top sub-panel is provided with the slot correspondingly at the bottom; to mount the first sub-panel after the electric control maintenance is completed, the collar of the first sub-panel can be inserted into the slot at the bottom of the top sub-panel at first. This may fix the position of the first sub-panel to facilitate the alignment between the first sub-panel and the shell, thereby may improve the efficiency of assembling. Moreover, in the assembling process of the whole unit, the plug-in engagement between the collar and the slot may be conducive to aligning the top sub-panel, the first sub-panel, and the shell accurately, and thus may improve the efficiency of assembling the whole unit.

In some embodiments, the collar is in a clearance fit with the slot so that the first sub-panel is adapted to rotate relative to the shell; the second sub-panel below and adjacent to the first sub-panel is denoted as the bottom sub-panel, and the top of the bottom sub-panel supports and engages the bottom of the first sub-panel.

The collar and the slot are in a clearance fit so that the first sub-panel can rotate relative to the shell. In this way, in the process of mounting the first sub-panel, after the collar is inserted into the slot, the lower end of the first sub-panel can be rotated towards the shell until the bottom of the first sub-panel is clamped on the top of the bottom sub-panel by gravity to position and fix the first sub-panel. The operation may be simple and quick, and may be no need to hold the first sub-panel by hand when assembling a fastener in the follow-up process, which may be conducive to improving the efficiency of assembling the product.

According to an embodiment of the present disclosure, the sub-panel includes a panel body and a flap connected to the panel body at an end, wherein the flap is provided with a connecting hole for mounting the fastener.

The sub-panel includes the panel body and the flap. The panel body is configured to cover a corresponding open portion of the mounting cavity to ensure the integrity of the appearance of the air-conditioner outdoor unit. The flap is provided with the connecting hole for mounting the fastener such as a screw, so that the flap can be connected to a structure such as the shell through the fastener such as the screw, rendering a high connection strength and secured fixation to ensure the reliability of the connection between the sub-panel and the structure such as the shell. Moreover, the fastener may be dismounted and mounted repeatedly to enable a detachable connection between the sub-panel and the structure such as the shell.

In some embodiments, the housing assembly includes the fastener, and the flap is connected to the shell of the housing assembly through the fastener; with a plane perpendicular to a thickness direction of the panel body as a projection plane, an orthographic projection of the fastener in the projection plane is denoted as a first orthographic projection, an orthographic projection of the panel body in the projection plane is denoted as a second orthographic projection, and the first orthographic projection is within the second orthographic projection.

In some embodiments, the flap is at least partially located behind the panel body because the flap is connected to the shell through the fastener. The thickness direction of the panel body is generally a front-rear direction of the air-conditioner outdoor unit, and thus the projection plane is vertical. The first orthographic projection is a front-to-rear orthographic projection of the fastener, and the second orthographic projection is a front-to-rear orthographic projection of the panel body. The first orthographic projection is within the second orthographic projection, that is, the orthographic projection of the fastener in the vertical plane is completely within the extent of the orthographic projection of the panel body in the vertical plane. In this way, in some embodiments, the fastener is completely blocked by the panel body when viewed from the front of the air-conditioner outdoor unit, and the fastener such as the screw is not seen from the front of the air-conditioner outdoor unit, may enable a hidden design of the fastener and improving the aesthetic appeal of the air-conditioner outdoor unit. Moreover, there may not be a need to additionally design an outer panel or other components for shielding the fastener, hence unnecessary components may be avoided and the production cost may be reduced.

In some embodiments, the flap includes a first connecting flap and a second connecting flap, wherein one end of the first connecting flap is connected to an end portion of the panel body, and the other end of the first connecting flap is configured to be oblique towards the middle of the panel body; the second connecting flap is bent from and connected to the other end of the first connecting flap and is configured to be oblique away from the middle of the panel body; the second connecting flap and the first connecting flap enclose an avoidance space, the second connecting flap is connected to the shell through the fastener, and a top of the fastener is located in the avoidance space.

In some embodiments, the flap includes the first connecting flap and the second connecting flap. One end of the first connecting flap is connected to an end of the panel body to enable a connection between the connecting flap and the panel body. The other end of the first connecting flap is configured to be oblique towards the middle of the panel body, that is, the first connecting flap is inclined towards an inner side of the panel body, the first connecting flap can be blocked by the panel body when viewed from the front of the shell. The second connecting flap is bent from and connected to the other end of the first connecting flap, and is connected to the shell through the fastener, rendering a firm connection between the sub-panel and the shell. The second connecting flap and the first connecting flap enclose the avoidance space, and the top of the fastener is located in the avoidance space, hence the fastener may be further blocked by the panel body when viewed from the front of the shell after the assembling process is completed. In this way, in some embodiments, a hidden design of the fastener may be rendered and may improve the aesthetic appeal of the housing assembly. In addition, since the second connecting flap is configured to be oblique away from the middle of the panel body, an acute angle structure is formed by the second connecting flap in relation to the panel body on a side of the air-conditioner outdoor unit, may render the assembling operation less difficult and more efficient when a plurality of the air-conditioner outdoor units are arranged side by side because an operator standing in front of the unit can drive the fastener into the holes from the side of the unit.

In some embodiments, the avoidance spaces of all sub-panels are in communication.

In some embodiments, the avoidance spaces of all the sub-panels are in communication to discharge rainwater smoothly, so that the fastener and other structures may be less likely to corrode due to the water accumulated in the air-conditioner outdoor unit, which may be conducive to extending the service life of the product. Moreover, the discharged rainwater may further remove rust or dust from the fastener, rendering a cleaner appearance for the air-conditioner outdoor unit.

According to some embodiments of the present disclosure, an air-conditioner outdoor unit is provided, including the housing assembly as described in any one of the embodiments of the first aspect, and an electric control box positioned to be corresponding to and shielded by the first sub-panel of the housing assembly.

According to some embodiments of the present disclosure, an air-conditioning apparatus is provided, including an air-conditioner indoor unit, and the air-conditioner outdoor unit according to the embodiment of the second aspect, wherein the air-conditioner outdoor unit is connected to the air-conditioner indoor unit.

BRIEF DESCRIPTION OF THE DRAWINGS

The foregoing and/or additional aspects and advantages of the present disclosure will become apparent and readily appreciated from the following description of the embodiments, taken in conjunction with the accompanying drawings, wherein.

Figure 1:
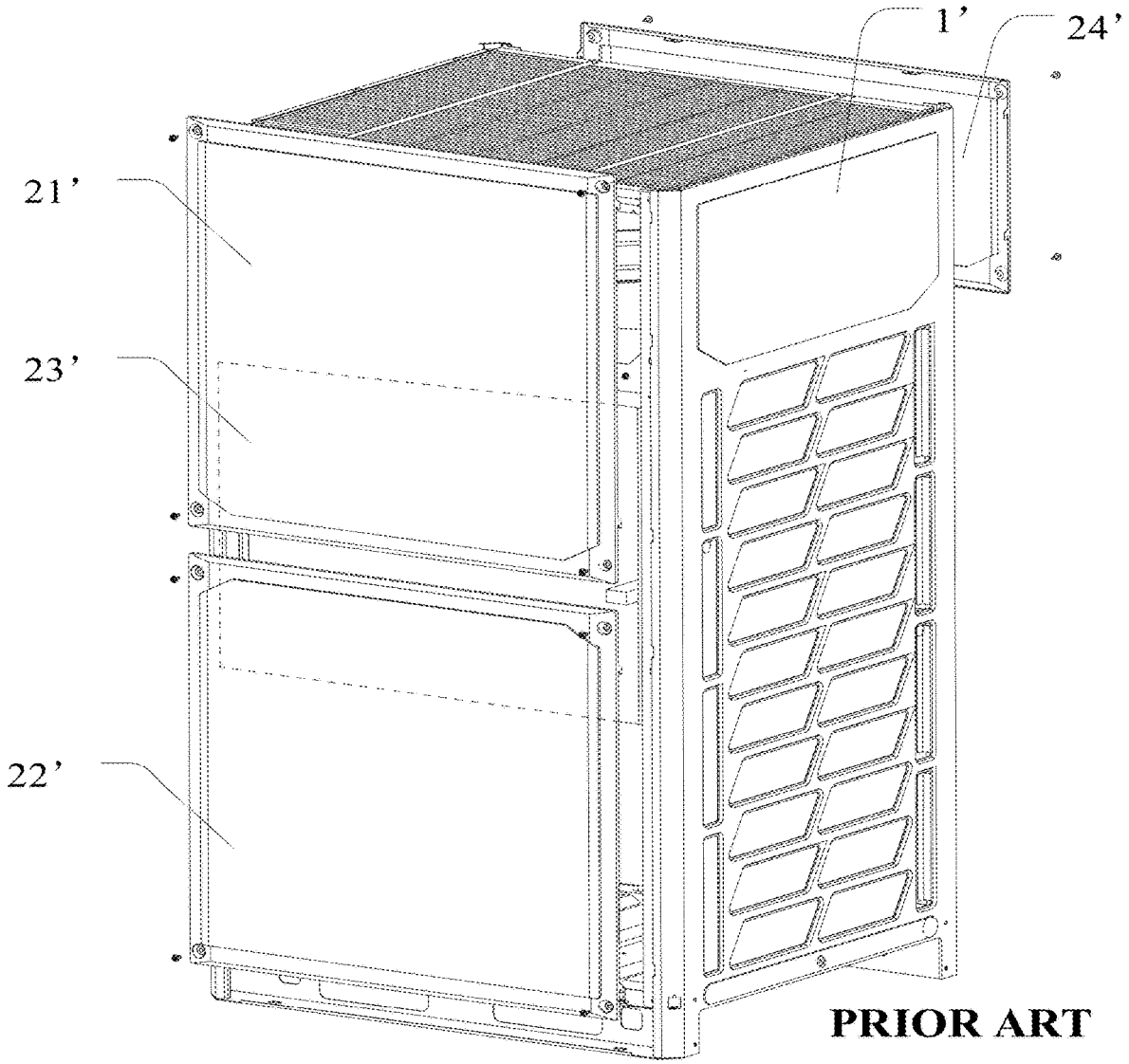
FIG. 1 is an exploded view of an air-conditioner outdoor unit in the prior art.

The list of the reference signs in FIG. 1:

1', shell; 21', upper panel; 22', lower panel; 23', electric control box; 24', back panel.

The list of the reference signs in FIGS. 2 to 8:

1, shell; 11, mounting cavity; 111, first opening; 112, second opening; 113, third opening; 13, bent edge; 131, plughole; 14, side panel;

2, panel; 20, sub-panel; 201, panel body; 202, flap; 2021, first connecting flap; 2022, second connecting flap; 2023, avoidance space; 2024, connecting hole; 21, first sub-panel; 211, collar; 22, second sub-panel; 221, catch; 2211, connecting portion; 2212, first hooking portion; 2213, second hooking portion; 23, top sub-panel; 24, bottom sub-panel;

3, back panel;

4, fastener;

100, housing assembly;

200, air-conditioner outdoor unit; 210, electric control box;

300, air-conditioning apparatus; 310, air-conditioner indoor unit.

DETAILED DESCRIPTION OF THE DISCLOSURE

In order that the above-recited objects, features, and advantages of the present disclosure may be more clearly understood, a detailed description of the disclosure will be rendered by reference to specific embodiments thereof which are illustrated in the appended drawings. It should be noted that the embodiments and features of the embodiments of the present disclosure can be combined with each other without conflict.

In the following description, numerous details are intended to provide a thorough understanding of the present disclosure. However, the present disclosure may be practiced otherwise than as specifically described herein. Therefore, the scope of the present disclosure is not limited to the embodiments disclosed below.

Hereinafter, a housing assembly, an air-conditioner outdoor unit, and an air-conditioning apparatus according to some embodiments of the present disclosure will be described with reference to FIGS. 2 to 8.

In an embodiment of the first aspect of the present disclosure, a housing assembly 100 for use in an air-conditioner outdoor unit 200 is provided. The housing assembly 100 includes a panel 2.

Figure 2:
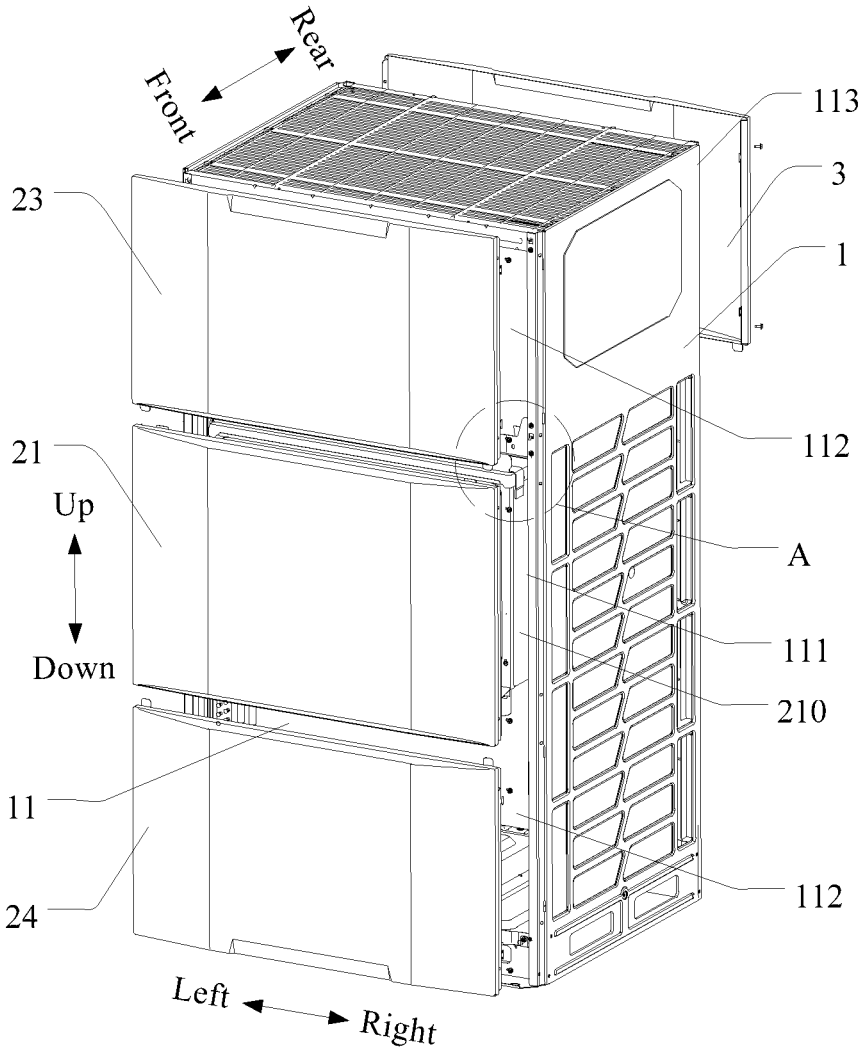
FIG. 2 is an exploded view of an air-conditioner outdoor unit according to an embodiment of the present disclosure.

In particular, as shown in FIG. 2, the panel 2 includes a plurality of sub-panels 20, the plurality of sub-panels 20 including a first sub-panel 21 and at least one second sub-panel 22, as shown in FIG. 2. The first sub-panel 21 is adapted to the electric control box 210 of the air-conditioner outdoor unit 200 for shielding the electric control box 210.

The housing assembly 100 provided in the embodiment of the first aspect of the present disclosure includes the panel 2, the panel 2 including the first sub-panel 21; since the first sub-panel 21 is adapted to the electric control box 210 of the air-conditioner outdoor unit 200, it is only necessary to remove the first sub-panel 21 to expose the electric control box 210 and repair the electric control box 210, without the need to remove two panels 2 to expose the electric control box 210 as in the prior art. Therefore, the electric control maintenance is less difficult and facilitated.

In particular, the first sub-panel 21 is adapted to a cover of the electric control box 210; when the first sub-panel 21 is removed, the cover of the electric control box 210 can be seen, and it is possible to open the cover of the electric control box 210 to repair or replace a structure in the electric control box 210. Furthermore, compared with providing a large-area panel 2 to shield the electric control box 210 and other components, the solution herein of separately providing the first sub-panel 21 adapted to the electric control box 210 at a position corresponding to the electric control box 210 is advantageous in reducing the size of the first sub-panel 21, thereby reducing the weight of the first sub-panel 21. Moreover, an operator is facilitated in disassembling and mounting the first sub-panel 21 for the electric control maintenance. Therefore, the electric control maintenance is much less difficult and further facilitated.

Figure 3:
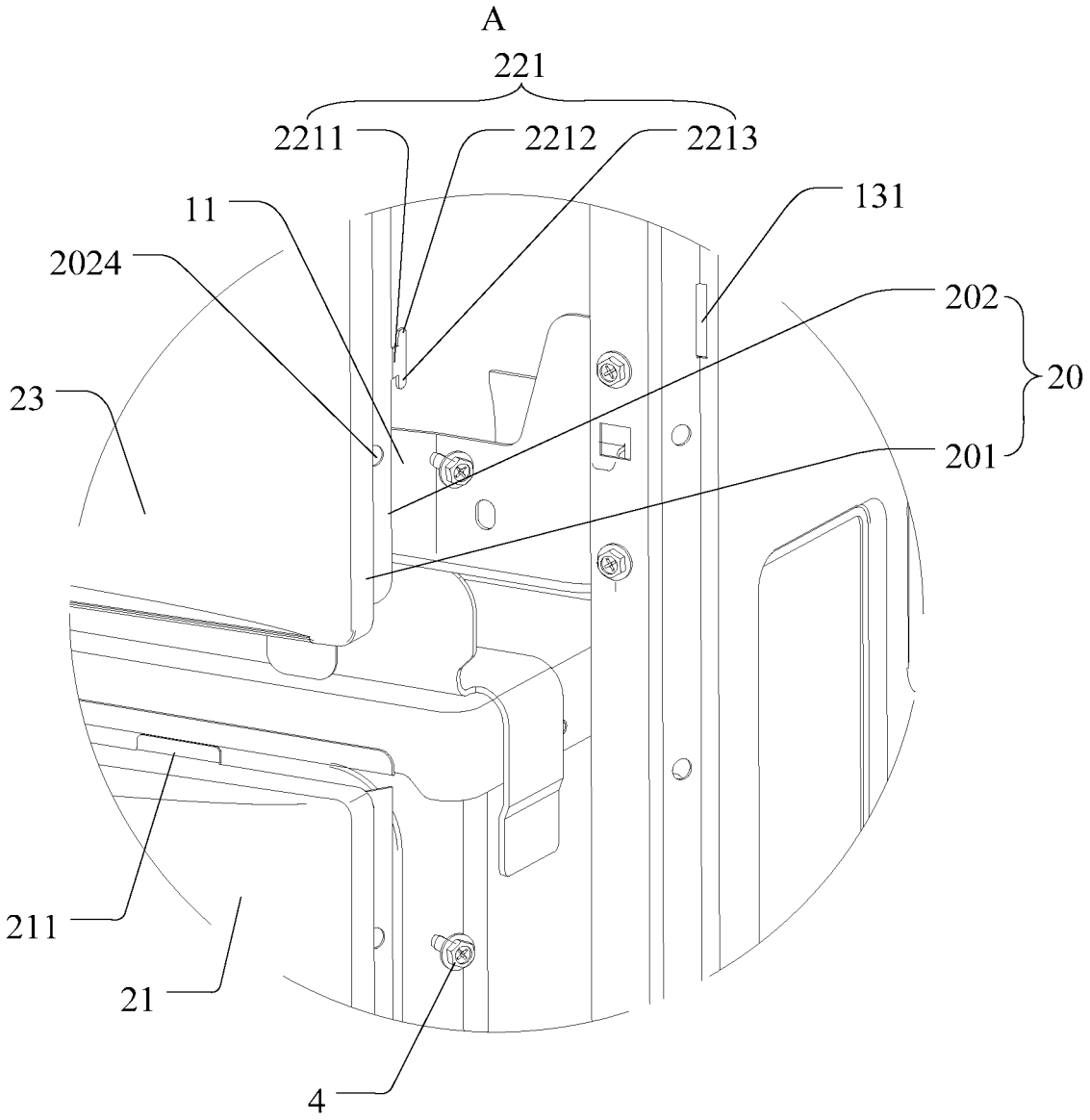
FIG. 3 is an enlarged view of FIG. 2 at A.

In a further embodiment of the present disclosure, as shown in FIG. 3, the housing assembly 100 includes a shell 1, as shown in FIG. 2, to which the panel 2 is detachably connected. One of the second sub-panel 22 and the shell 1 is provided with a catch 221, and the other is provided with a plughole 131, the catch 221 being in plug-in engagement with the plughole 131.

The housing assembly 100 includes a shell 1, components such as the electric control box 210 and a heat exchanger are mounted inside the shell 1, and the panel 2 is detachably connected to the shell 1 to shield the components such as the electric control box 210 and the heat exchanger inside the shell 1 to ensure the integrity of the appearance of the air-conditioner outdoor unit. One of the second sub-panel 22 and the shell 1 is provided with the catch 221, and the other is provided with the plughole 131. That is, the second sub-panel 22 is provided with the catch 221, and the shell is provided with the plughole 131; alternatively, the second sub-panel 22 is provided with the plughole 131, and the shell is provided with the catch 221.

In the assembling process, the catch 221 is plugged into the plughole 131 to enable a hooked connection between the second sub-panel 22 and the shell 1, so that the second sub-panel 22 is properly positioned to render a good alignment between the second sub-panel 22 and the shell 1. In this way, the second sub-panel 22 is prevented from randomly moving relative to the shell 1, and the assembling of fasteners 4 such as screws in the subsequent assembling process is facilitated; accordingly, the assembling process of the second sub-panel 22 is less difficult, and the air-conditioner outdoor unit 200 can be assembled more efficiently.

In an embodiment of the present disclosure, in particular, as shown in FIG. 3, the catch 221 includes a connecting portion 2211, a first hooking portion 2212, and a second hooking portion 2213.

Herein, the connecting portion 2211 is connected to the second sub-panel 22 or the shell 1. The first hooking portion 2212 is bent from and connected to the connecting portion 2211, and passes through the plughole 131. The second hooking portion 2213 is bent from and connected to the connecting portion 2211, and passes through the plughole 131; the second hooking portion 2213 is bent in a direction opposite the first hooking portion 2212.

The catch 221 includes the connecting portion 2211, the first hooking portion 2212, and the second hooking portion 2213. In a solution that the catch 221 is provided on the second sub-panel 22, the connecting portion 2211 is connected to the second sub-panel 22 to enable a connection between the catch 221 and the second sub-panel 22. In a solution that the catch 221 is provided on the shell 1, the connecting portion 2211 is connected to the shell 1 to enable a connection between the catch 221 and the shell 1. The first hooking portion 2212 is bent from and connected to the connecting portion 2211 to form a hook structure so that the hooked connection between the second sub-panel 22 and the shell 1 is enabled by the hook structure. The second hooking portion 2213 is bent from and connected to the connecting portion 2211, and the second hooking portion 2213 is bent in the direction opposite the first hooking portion 2212 to form another hook structure, through which the hooked connection between the second sub-panel 22 and the shell 1 can further be enabled. Since the two hook structures are in opposite directions, the hooked connection between the second sub-panel 22 and the shell 1 can be enabled by either the first hooking portion 2212 or the second hooking portion 2213. Therefore, the assembling process of the second sub-panel 22 is less difficult, which is conducive to a more efficient assembling process of the product.

Furthermore, the number of the connecting portion 2211 may be one or more. For example, if the number of the connecting portion 2211 is one, the catch 221 is of a T-shaped structure; if the number of the connecting portion 2211 is two, the catch 221 includes two L-shaped structures in opposite directions.

In a further embodiment of the present disclosure, the first hooking portion 2212 and the second hooking portion 2213 are arranged along a height of the shell 1, as shown in FIG. 3.

The first hooking portion 2212 and the second hooking portion 2213 are arranged along a height of the shell 1, and the height of the shell 1 is generally in an up-down direction, so that the first hooking portion 2212 and the second hooking portion 2213 are provided on upper and lower sides of the connecting portion 2211. In the assembling process, the catch 221 can be plugged into the plughole 131 horizontally, and the hooked connection between the second sub-panel 22 and the shell 1 can be enabled by the hook structure on the lower side by gravity. In this way, the shell 1 can support the second sub-panel 22, requiring less force applied by an operator; therefore, the operation is less difficult and the assembling process of the product is more efficient.

In a further embodiment of the present disclosure, the number of the catches 221 is more than one, the plurality of catches 221 are divided into two groups, and the two groups of catches 221 are arranged symmetrically around a center line of the corresponding second sub-panel 22.

When the number of the catches 221 is more than one, the number of the plugholes 131 is further more than one, and the plurality of plugholes 131 are arranged in one-to-one correspondence with the plurality of catches 221. This leverages the engagement of the plurality of catches 221 with the plurality of plugholes 131 to position and assemble the shell 1 and the second sub-panel 22 properly. Moreover, the plurality of catches 221 are divided into two groups, and the two groups of catches 221 are arranged symmetrically around a center line of the corresponding second sub-panel 22; as such, even if the second sub-panel 22 rotates 180° around the center line thereof, the two groups of catches 221 can still be engaged with the two groups of plugholes 131 in a one-to-one correspondence, and the shell 1 can still be engaged with the plugholes 131 through the catches 221, hence a reasonable choice of a method for assembling the second sub-panel 22 can be made according to product requirements, which is conducive to the versatility of the second sub-panel 22. Herein, the center line of the second sub-panel 22 refers to a straight line perpendicular to a plane of the second sub-panel 22 at a center thereof, which is further perpendicular to a plane of the corresponding second opening 112 and passes through the plane of the corresponding second opening 112 at a center thereof.

In addition, the number of the catches 221 is generally an even number, and the catches 221 are arranged symmetrically up and down and left and right. Therefore, the second sub-panel 22 can be freely rotated upwards and downwards in the assembling process, so that the catch 221 can be rotated 360° and engaged with the plughole 131. In other words, the second sub-panel 22, even if turned upside down by 180°, can still have the hooked connection thereof with the shell 1 through the engagement of the catch 221 with the plughole 131.

In a further embodiment of the present disclosure, the first hooking portion 2212 and the second hooking portion 2213 are structurally the same, and the first hooking portion 2212 and the second hooking portion 2213 are arranged on both sides of the connecting portion 2211 in mirror symmetry, as shown in FIG. 3.

The first hooking portion 2212 and the second hooking portion 2213 are structurally the same, and the first hooking portion 2212 and the second hooking portion 2213 are arranged on both sides of the connecting portion 2211 in mirror symmetry, so that the structure of the catch 221 is relatively regular and convenient for processing and shaping. Moreover, since the sub-panel 20 is generally of a symmetrical structure, such an arrangement facilitates that the second sub-panel 22, even if turned upside down by 180°, can still be positioned and assembled with the shell 1 through the engagement of the catch 221 with the plughole 131, hence a reasonable choice of a direction in which the second sub-panel 22 is to be assembled can be made according to the position of the second sub-panel 22, which is conducive to improving the versatility of the second sub-panel 22.

In a further embodiment of the present disclosure, a mounting cavity 11 is provided in the shell 1, the mounting cavity 11 has an open end, the open end of the mounting cavity 11 includes a first opening 111 and a second opening 112, the first opening 111 corresponds to the electric control box 210, and the second sub-panel 22 is adapted to the second opening 112.

Figure 4:
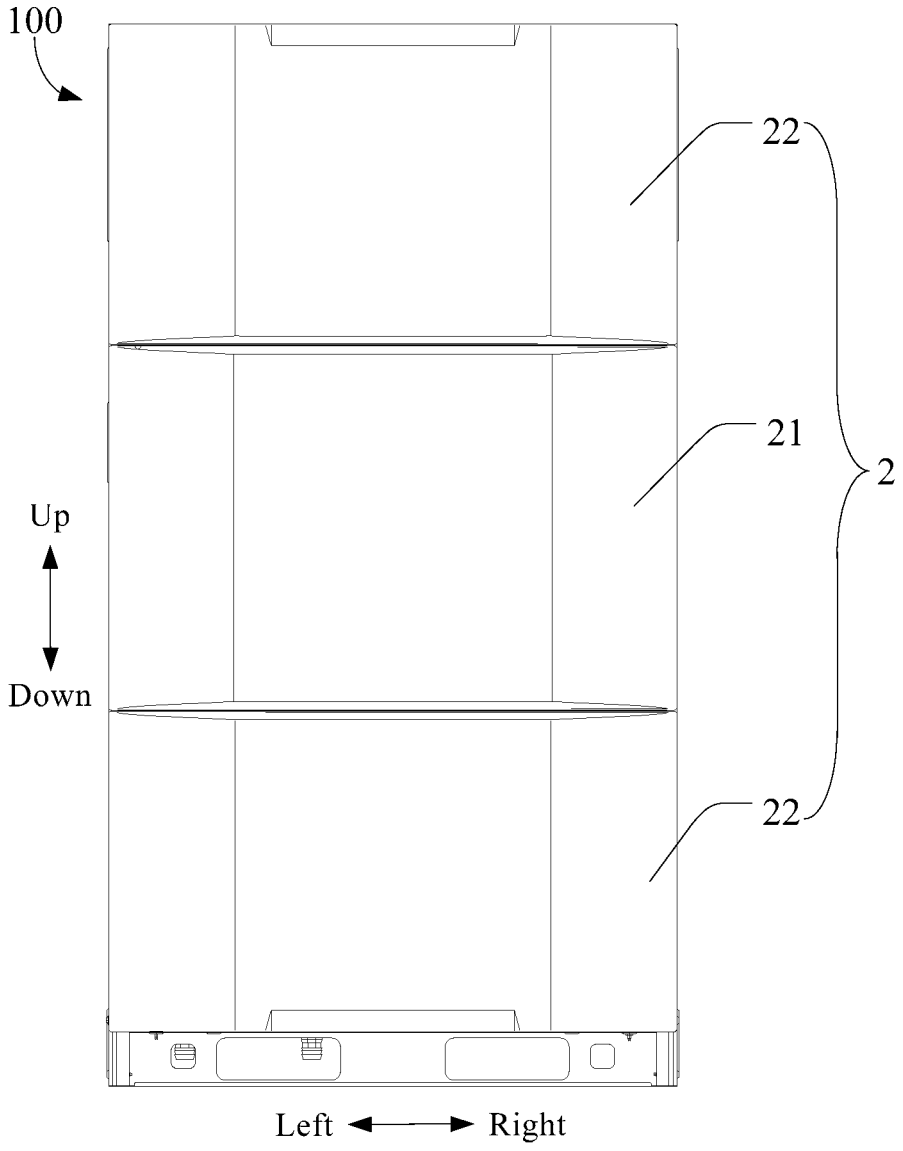
FIG. 4 is a front view of a housing assembly according to an embodiment of the present disclosure.

Furthermore, the number of the second opening 112 is more than one, as shown in FIG. 1. The number of the second sub-panel 22 is more than one, as shown in FIG. 4. A plurality of the second sub-panels 22 has a one-to-one correspondence to a plurality of the second openings 112. The first sub-panel 21 and the plurality of the second sub-panels 22 are arranged along a height of the shell 1, as shown in FIG. 4, and either side of the first sub-panel 21 is provided with at least one second sub-panel 22.

In this embodiment, one end of the mounting cavity 11 of the shell 1 is open, so that components such as the heat exchanger and the electric control box 210 can be conveniently and quickly mounted inside the shell 1 through the open end of the mounting cavity 11, and then the panel 2 is mounted to cover the open end of the mounting cavity 11, whereby the integrity of the appearance of the air-conditioner outdoor unit is ensured.

The open end of the mounting cavity 11 includes the first opening 111 and the second opening 112. Accordingly, the panel 2 includes the first sub-panel 21 and at least one second sub-panel 22. The first opening 111 corresponds to the electric control box 210, and thus the first sub-panel 21 is adapted to the first opening 111 of the mounting cavity 11 and can cover the first opening 111 of the mounting cavity 11 to shield the electric control box 210. The second sub-panel 22 is adapted to cover the second opening 112 of the mounting cavity 11 so that an opening elsewhere of the mounting cavity 11 can be covered, thereby ensuring that the panel 2 covers the open end of the mounting cavity 11.

In a particular case where the electric control box 210 is to be repaired, it is necessary to remove only the first sub-panel 21, without a need to remove the second sub-panel 22. Therefore, the operation is facilitated and less difficult for an operator, and it is more convenient to perform the electric control maintenance.

Moreover, the configuration of the second opening 112 and the second sub-panel 22 further facilitates the maintenance of the heat exchanger or other components.

Herein, the number of the second openings 112 is more than one, and accordingly, the number of the second sub-panels 22 is more than one; the plurality of the second sub-panels 22 has a one-to-one correspondence to the plurality of the second openings 112 to ensure that each second opening 112 can be covered. Moreover, the first sub-panel 21 and the plurality of second sub-panels 22 are arranged along the height (i.e., an up-down direction) of the shell 1, and either side of the first sub-panel 21 is provided with at least one second sub-panel 22, that is, the first sub-panel 21 is located at a position closer to the middle of the panel 2. As featured in an air-conditioner outdoor unit 200, the heat exchanger is generally placed near a lower end of the body of the unit and the electric control box 210 is placed around the middle. Therefore, a position closer to the middle of the first sub-panel 21 corresponds to a position of the electric control box 210 of the air-conditioner outdoor unit 200 in the prior art, and the internal structure of the shell 1 can be designed conventionally, thereby saving the cost of molding for the housing assembly 100.

Figure 5:
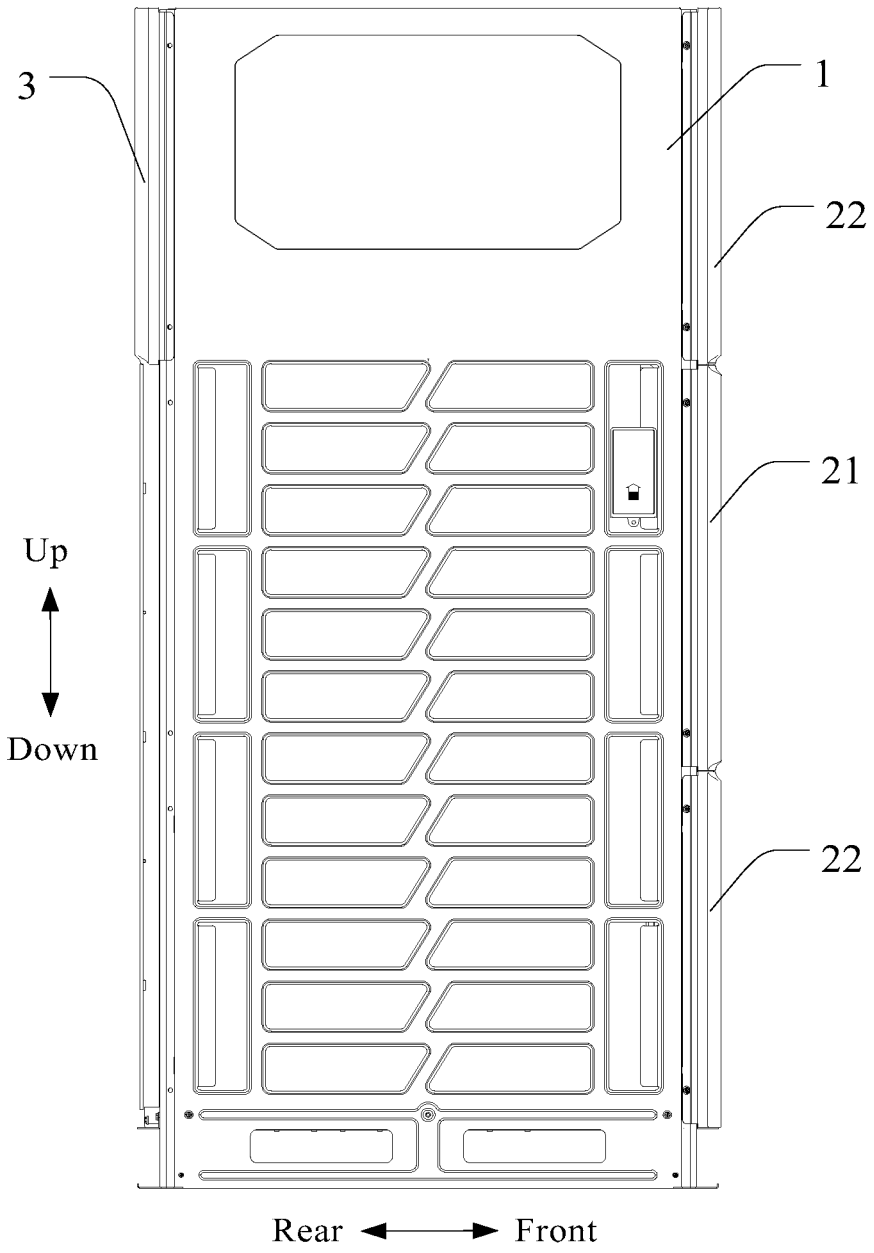
FIG. 5 is a right view of the housing assembly according to an embodiment of the present disclosure.
Figure 6:
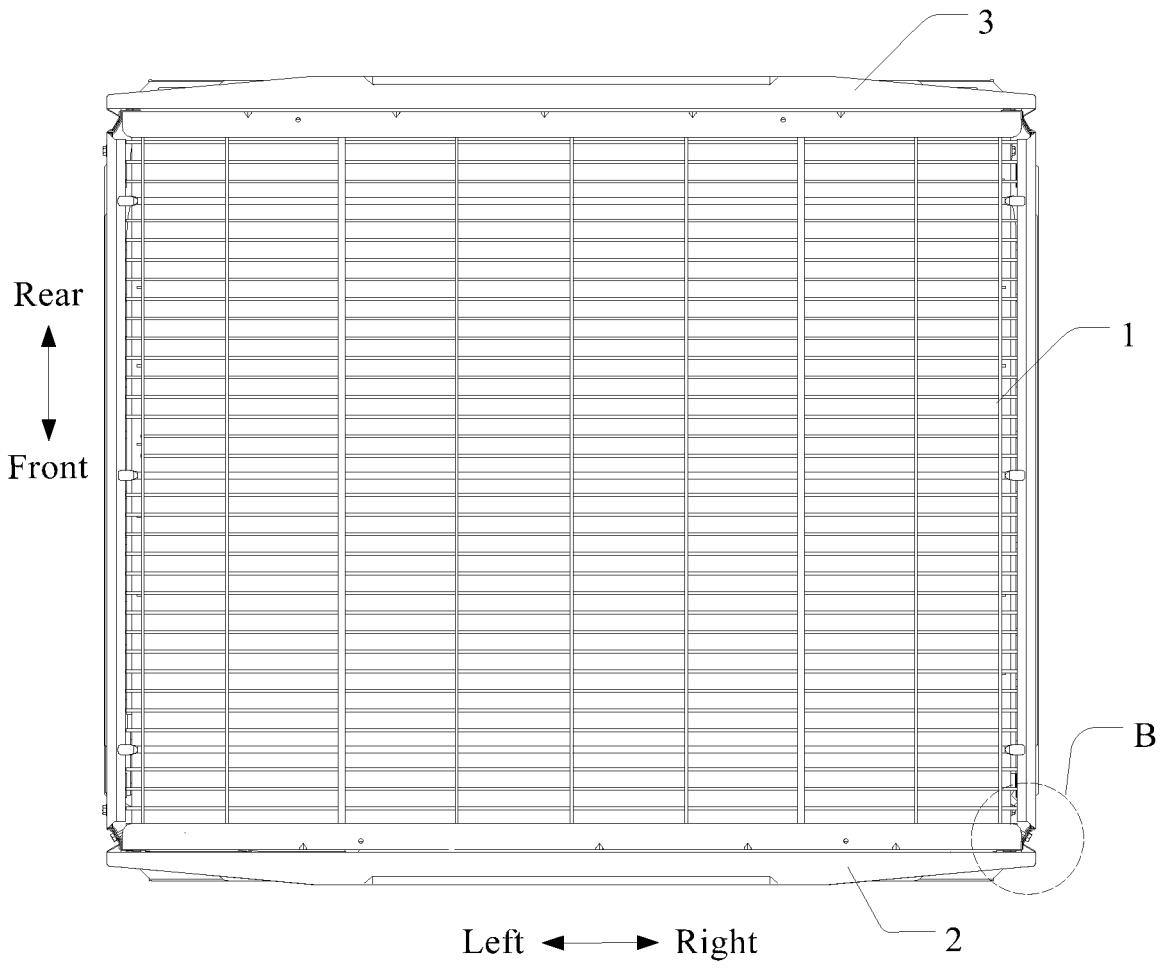
FIG. 6 is a top view of the housing assembly according to an embodiment of the present disclosure.

In an embodiment of the present disclosure, the mounting cavity 11 is provided with a third opening 113, as shown in FIG. 2. The third opening 113 is disposed opposite the open end of the mounting cavity 11. The housing assembly 100 further includes a back panel 3 as shown in FIGS. 2, 5, and 6. The back panel 3 is detachably connected to the shell 1 for opening or closing the third opening 113.

The mounting cavity 11 is provided with the third opening 113, and the third opening 113 is opposite the open end of the mounting cavity 11, that is, the open end of the mounting cavity 11 is located at the front of the shell 1, and the third opening 113 is located at the back of the shell 1. Accordingly, the housing assembly 100 further includes the back panel 3, where the back panel 3 is detachably connected to the shell 1 and covers the third opening 113 to ensure the integrity of the appearance of the air-conditioner outdoor unit 200. In addition, the back panel 3 can be removed for an overhaul on the components near a rear portion in the shell 1, hence the maintenance of the air-conditioner outdoor unit 200 is less difficult and facilitated.

In a further embodiment of the present disclosure, the back panel 3 is structurally the same as the second sub-panel 22, such that the back panel 3 and the second sub-panel 22 are in common use.

The back panel 3 is structurally the same as the second sub-panel 22, that is, the back panel 3 and the second sub-panel 22 are the same components and are in common use, effectively improving the versatility of the components. This makes it possible to reduce the number of new molds for components and then save on the cost of molding.

With reference to FIG. 1, in the prior art, the upper panel 21' and lower panel 22' are distinct components from the back panel 24'. Therefore, the back panel 24' is designed separately from the upper panel 21' and the lower panel 22' and separately molded, which leads to poor replaceability among the components and a high cost.

However, in this embodiment, the back panel 3 and the second sub-panel 22 are in common use, and it is not necessary to design or mold the back panel 3 separately, thereby improving the versatility of the product components, reducing the cost of molding, and saving the cost for production.

In a further embodiment of the present disclosure, the first sub-panel 21 is provided with a collar 211 at the top, as shown in FIG. 3. The second sub-panel 22 above and adjacent to the first sub-panel 21 is a top sub-panel 23, as shown in FIG. 2. The top sub-panel 23 is provided with a slot at the bottom, and the collar 211 is in plug-in engagement with the slot.

The first sub-panel 21 is provided with the collar 211 at the top, and the top sub-panel 23 is provided with the slot correspondingly at the bottom; to mount the first sub-panel 21 after the electric control maintenance is completed, the collar 211 of the first sub-panel 21 can be inserted into the slot at the bottom of the top sub-panel 23 at first. This can fix the position the first sub-panel 21 to facilitate the alignment between the first sub-panel 21 and the shell 1, thereby improving the efficiency of assembling. Moreover, in the assembling process of the whole unit, the plug-in engagement between the collar 211 and the slot is conducive to aligning the top sub-panel 23, the first sub-panel 21, and the shell 1 accurately, and thus improves the efficiency of assembling the whole unit.

In a further embodiment of the present disclosure, the collar 211 is in a clearance fit with the slot so that the first sub-panel 21 is adapted to rotate relative to the shell 1. The second sub-panel 22 below and adjacent to the first sub-panel 21 is the bottom sub-panel 24, as shown in FIG. 2. The top of the bottom sub-panel 24 is configured to support and engage the bottom of the first sub-panel 21.

The collar 211 and the slot are in a clearance fit so that the first sub-panel 21 can rotate relative to the shell 1. In this way, in the process of mounting the first sub-panel 21, after the collar 211 is inserted into the slot, the lower end of the first sub-panel 21 can be rotated towards the shell 1 until the bottom of the first sub-panel 21 is clamped on the top of the bottom sub-panel 24 by gravity to position and fix the first sub-panel 21. The operation is simple and quick, and there is no need to hold the first sub-panel 21 by hand when assembling a fastener 4 in the follow-up process, which is conducive to improving the efficiency of assembling the product.

Figure 7:
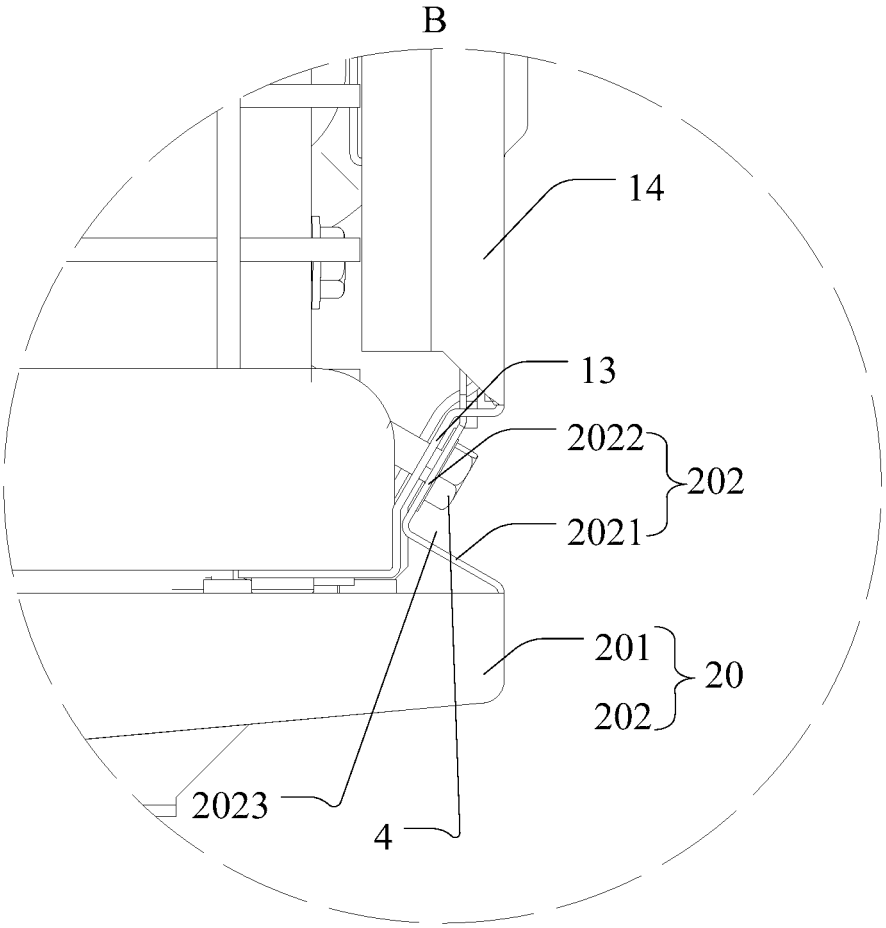
FIG. 7 is an enlarged view of FIG. 6 at B.

In a further embodiment of the present disclosure, the sub-panel 20 includes a panel body 201 and a flap 202, as shown in FIG. 7. The flap 202 is connected to the panel body 201 at an end, and the flap 202 is provided with a connecting hole 2024 for mounting the fastener 4.

The sub-panel 20 includes the panel body 201 and the flap 202. The panel body 201 is configured to cover a corresponding open portion of the mounting cavity 11 to ensure the integrity of the appearance of the air-conditioner outdoor unit 200. The flap 202 is provided with the connecting hole 2024 for mounting the fastener 4 such as a screw, so that the flap 202 can be connected to a structure such as the shell 1 through the fastener 4 such as the screw, rendering a high connection strength and secured fixation to ensure the reliability of the connection between the sub-panel 20 and the structure such as the shell 1. Moreover, the fastener 4 can further be dismounted and mounted repeatedly to enable a detachable connection between the sub-panel 20 and the structure such as the shell 1.

In an embodiment of the present disclosure, the housing assembly 100 includes the fastener 4, and the flap 202 is connected to the shell 1 of the housing assembly 100 through the fastener 4. With a plane perpendicular to a thickness direction of the panel body 201 as a projection plane, an orthographic projection of the fastener 4 in the projection plane is a first orthographic projection, an orthographic projection of the panel body 201 in the projection plane is a second orthographic projection, and the first orthographic projection is within the second orthographic projection.

In this embodiment, the flap 202 is at least partially located behind the panel body 201 because the flap 202 is connected to the shell 1 through the fastener 4. The thickness direction of the panel body 201 is generally a front-rear direction of the air-conditioner outdoor unit, and thus the projection plane is vertical. The first orthographic projection is a front-to-rear orthographic projection of the fastener 4, and the second orthographic projection is a front-to-rear orthographic projection of the panel body 201. The first orthographic projection is within the second orthographic projection, that is, the orthographic projection of the fastener 4 in the vertical plane is completely within the extent of the orthographic projection of the panel body 201 in the vertical plane. In this way, the fastener 4 is completely blocked by the panel body 201 when viewed from the front of the air-conditioner outdoor unit, and the fastener 4 such as the screw is not seen from the front of the air-conditioner outdoor unit, thereby enabling a hidden design of the fastener 4 and improving the aesthetic appeal of the air-conditioner outdoor unit. Moreover, there is no need to additionally design an outer panel or other components for shielding the fastener 4, hence unnecessary components are avoided and the production cost is reduced.

In a further embodiment of the present disclosure, the flap 202 includes a first connecting flap 2021 and a second connecting flap 2022, as shown in FIG. 7.

Herein, one end of the first connecting flap 2021 is connected to an end portion of the panel body 201, and the other end of the first connecting flap 2021 is configured to be oblique towards the middle of the panel body 201. The second connecting flap 2022 is bent from and connected to the other end of the first connecting flap 2021 and is configured to be oblique away from the middle of the panel body 201. The second connecting flap 2022 and the first connecting flap 2021 enclose an avoidance space 2023, as shown in FIG. 7. The second connecting flap 2022 is connected to the shell 1 through the fastener 4, and a top of the fastener 4 is located in the avoidance space 2023.

The flap 202 includes the first connecting flap 2021 and the second connecting flap 2022. One end of the first connecting flap 2021 is connected to an end of the panel body 201 to enable a connection between the connecting flap 202 and the panel body 201. The other end of the first connecting flap 2021 is configured to be oblique towards the middle of the panel body 201, that is, the first connecting flap 2021 is inclined towards an inner side of the panel body 201, the first connecting flap 2021 can be blocked by the panel body 201 when viewed from the front of the shell 1. The second connecting flap 2022 is bent from and connected to the other end of the first connecting flap 2021, and is connected to the shell 1 through the fastener 4, rendering a firm connection between the sub-panel 20 and the shell 1. The second connecting flap 2022 and the first connecting flap 2021 enclose the avoidance space 2023, and the top of the fastener 4 is located in the avoidance space 2023, hence the fastener 4 can further be blocked by the panel body 201 when viewed from the front of the shell 1 after the assembling process is completed, as shown in FIG. 4. In this way, the solution renders a hidden design of the fastener 4 and improves the aesthetic appeal of the housing assembly 100.

In addition, since the second connecting flap 2022 is configured to be oblique away from the middle of the panel body 201, an acute angle structure is formed by the second connecting flap 2022 in relation to the panel body 201 on a side of the air-conditioner outdoor unit, which renders the assembling operation less difficult and more efficient when a plurality of the air-conditioner outdoor units are arranged side by side because an operator standing in front of the unit can drive the fastener 4 into the holes from the side of the unit.

According to an embodiment of the present disclosure, the avoidance spaces 2023 of all the sub-panels 20 are in communication.

The avoidance spaces 2023 of all the sub-panels 20 are in communication to discharge rainwater smoothly, so that the fastener 4 and other structures are less likely to corrode due to the water accumulated in the air-conditioner outdoor unit, which is conducive to extending the service life of the product. Moreover, the discharged rainwater can further remove rust or dust from the fastener 4, rendering a cleaner appearance for the air-conditioner outdoor unit.

In an embodiment of the present disclosure, the second connecting flap 2022 and the first connecting flap 2021 are perpendicular to each other, as shown in FIG. 7.

The second connecting flap 2022 and the first connecting flap 2021 are perpendicular to each other, which is conducive to improving the strength of the flap 202 and reducing the risk of deformation of the second connecting flap 2022 and the first connecting flap 2021, thereby improving the strength and reliability of the connection between the shell 1 and the sub-panel 20.

In a further embodiment of the present disclosure, the shell 1 includes a side panel 14 and a bent edge 13, as shown in FIG. 7. The bent edge 13 is connected to the side panel 14 and is parallel to the second connecting flap 2022, and the bent edge 13 is connected to the second connecting flap 2022 through the fastener 4.

The shell 1 includes the side panel 14 and the bent edge 13, wherein two side panels 14 are provided respectively at the left and right ends of the shell 1. The bent edge 13 is connected to an end of the side panel 14, and the bent edge 13 is parallel to the second connecting flap 2022 and is connected to the second connecting flap 2022 through the fastener 4, to facilitate assembling and ensure the reliability of the connection between the sub-panel 20 and the shell 1. In particular, the bent edge 13 is provided with the connecting hole 2024, the second connecting flap 2022 is provided with the connecting hole 2024, and the fastener 4 passes through the connecting hole 2024 of the bent edge 13 and the connecting hole 2024 of the second connecting flap 2022, so that the shell 1 and the sub-panel 20 can be fastened and connected.

As shown in FIG. 2, an embodiment of the second aspect of the present disclosure provides an air-conditioner outdoor unit 200, including the housing assembly 100 and the electric control box 210 as described in any of the embodiments of the first aspect. The electric control box 210 is configured corresponding to and is shielded by the first sub-panel 21 of the housing assembly 100.

In an embodiment of the present disclosure, the air-conditioner outdoor unit 200 is a multi-unit outdoor unit. Apparently, the air-conditioner outdoor unit 200 of the air-conditioning apparatus provided in the present disclosure is not limited to a multi-unit outdoor unit but can be a common outdoor unit.

The air-conditioner outdoor unit 200 provided in an embodiment of the second aspect of the present disclosure includes the housing assembly 100 according to any of the embodiments of the first aspect, hence it is only necessary to remove the first sub-panel 21 to expose the electric control box 210 and repair the electric control box 210, without the need to remove two panels to expose the electric control box 210 as in the prior art. Therefore, the electric control maintenance is less difficult and facilitated. Moreover, the air-conditioner outdoor unit 200 has all the advantages of any of the above-described embodiments, which will not be described in detail herein.

In an embodiment of the present disclosure, the air-conditioner outdoor unit 200 is a multi-unit outdoor unit, and the air-conditioning apparatus 300 is a multi-unit air-conditioning apparatus. Apparently, the air-conditioner outdoor unit 200 provided in the present disclosure is not limited to a multi-unit outdoor unit but may be a common outdoor unit. Accordingly, the air-conditioning apparatus 300 is not limited to a multi-unit air-conditioning apparatus but may be a common air-conditioning apparatus.

An embodiment will now be described with reference to the accompanying drawings and compared with the prior art.

FIG. 1 is an exploded view of an air-conditioner outdoor unit in the prior art. As featured in an air-conditioner outdoor unit, the heat exchanger is generally placed near a lower end of the body of the unit and the electric control box is placed around the middle. A front panel is generally designed to include two parts, while a rear upper panel 21' is designed separately. When the electric control box is to be repaired, two panels need to be disassembled, so the operation is not convenient, and the parts have poor versatility.

In other words, the panel of the air-conditioner outdoor unit in the prior art includes an upper panel 21' and a lower panel 22'. The dashed box in FIG. 1 indicates the position of an electric control box 23'. Since the electric control box 23' is covered by a lower portion of the upper panel 21' and an upper portion of the lower panel 22', the upper panel 21' and the lower panel 22' need to be removed when the electric control box 23' is to be repaired, resulting in inconvenience in operation. Moreover, the back panel 24' is different from the upper panel 21' and the lower panel 22', and needs to be designed and molded separately. Therefore, the parts have poor versatility and feature a high cost.

The present embodiment provides an air-conditioner outdoor unit 200, including a housing assembly 100 and an electric control box 210.

The housing assembly 100 includes a shell 1 and a panel 2.

In particular, as shown in FIG. 2, the panel 2 includes a plurality of sub-panels 20, and the plurality of sub-panels 20 include a first sub-panel 21 and at least one second sub-panel 22, as shown in FIG. 4. The first sub-panel is adapted to the electric control box 210 of the air-conditioner outdoor unit 200 for shielding the electric control box 210.

Furthermore, the mounting cavity 11 has an open end, and the open end of the mounting cavity 11 includes a first opening 111 and a second opening 112. The first opening 111 is provided corresponding to the electric control box 210. The second sub-panel 22 is adapted to the second opening 112 for opening or closing the second opening 112.

In particular, two second openings 112 are provided, as shown in FIG. 1. Two second sub-panels 22 are provided, as shown in FIG. 4. The two second sub-panels 22 are in one-to-one correspondence with the two second openings 112. The first sub-panel 21 and the plurality of second sub-panels 22 are arranged along a height of the shell 1, as shown in FIG. 4, and one second sub-panel 22 is arranged on either side of the first sub-panel 21.

Furthermore, as shown in FIG. 3, the second sub-panel 22 is provided with a catch 221, and the shell 1 is provided with a plughole 131, with which the catch 221 is in plug-in engagement.

In particular, as shown in FIG. 3, the catch 221 includes a connecting portion 2211, a first hooking portion 2212, and a second hooking portion 2213.

Herein, the connecting portion 2211 is connected to the second sub-panel 22 or the shell 1. The first hooking portion 2212 is bent from and connected to the connecting portion 2211, and passes through the plughole 131. The second hooking portion 2213 is bent from and connected to the connecting portion 2211, and passes through the plughole 131; the second hooking portion 2213 is bent in a direction opposite the first hooking portion 2212.

Furthermore, the first hooking portion 2212 and the second hooking portion 2213 are arranged along a height of the shell 1, as shown in FIG. 3.

Furthermore, one second sub-panel 22 is provided with four catches 221, and the four catches 221 are divided into two groups. The two groups of catches 221 are arranged symmetrically around a center line of the corresponding second sub-panel 22.

Furthermore, the first hooking portion 2212 and the second hooking portion 2213 are structurally the same, and the first hooking portion 2212 and the second hooking portion 2213 are arranged on both sides of the connecting portion 2211 in mirror symmetry, as shown in FIG. 3.

Furthermore, the mounting cavity 11 is provided with a third opening 113, as shown in FIG. 2. The third opening 113 is disposed opposite the open end of the mounting cavity 11. The housing assembly 100 further includes a back panel 3 as shown in FIGS. 1, 5, and 6. The back panel 3 is detachably connected to the shell 1 for opening or closing the third opening 113.

Furthermore, the back panel 3 is structurally the same as the second sub-panel 22, such that the back panel 3 and the second sub-panel 22 are in common use.

Furthermore, the first sub-panel 21 is provided with a collar 211 at the top, as shown in FIG. 3. The second sub-panel 22 above and adjacent to the first sub-panel 21 is a top sub-panel 23, as shown in FIG. 2. The top sub-panel 23 is provided with a slot at the bottom, and the collar 211 is in plug-in engagement with the slot.

Furthermore, the collar 211 is in a clearance fit with the slot so that the first sub-panel 21 is adapted to rotate relative to the shell 1. The second sub-panel 22 below and adjacent to the first sub-panel 21 is the bottom sub-panel 24, as shown in FIG. 2. The top of the bottom sub-panel 24 is configured to support and engage the bottom of the first sub-panel 21.

Furthermore, the sub-panel 20 includes a panel body 201 and a flap 202, as shown in FIG. 7. The flap 202 is connected to the panel body 201 at an end, and connected to the shell 1 through a fastener 4.

Furthermore, with a plane perpendicular to a thickness direction of the panel body 201 as a projection plane, an orthographic projection of the fastener 4 in the projection plane is a first orthographic projection, an orthographic projection of the panel body 201 in the projection plane is a second orthographic projection, and the first orthographic projection is within the second orthographic projection.

Furthermore, the flap 202 includes a first connecting flap 2021 and a second connecting flap 2022, as shown in FIG. 7.

Herein, one end of the first connecting flap 2021 is connected to an end portion of the panel body 201, and the other end of the first connecting flap 2021 is configured to be oblique towards the middle of the panel body 201. The second connecting flap 2022 is bent from and connected to the other end of the first connecting flap 2021 and is configured to be oblique away from the middle of the panel body 201. The second connecting flap 2022 and the first connecting flap 2021 enclose an avoidance space 2023, as shown in FIG. 7. The second connecting flap 2022 is connected to the shell 1 through the fastener 4, and a top of the fastener 4 is located in the avoidance space 2023.

Furthermore, the avoidance spaces 2023 of all the sub-panels 20 are in communication.

In particular, the second connecting flap 2022 and the first connecting flap 2021 are perpendicular to each other, as shown in FIG. 7.

Furthermore, the shell 1 includes a side panel 14 and a bent edge 13, as shown in FIG. 7. The bent edge 13 is connected to the side panel 14 and is parallel to the second connecting flap 2022, and the bent edge 13 is connected to the second connecting flap 2022 through the fastener 4.

As described above, in the housing assembly 100 of the air-conditioner outdoor unit 200 according to the present embodiment, the panel 2 in the front of the air-conditioner outdoor unit 200 is designed to include three sub-panels, and only the first sub-panel 21 in the middle needs to be removed for maintenance, which facilitates the electric control maintenance.

Moreover, the top sub-panel 23 at the top portion, the bottom sub-panel 24 at the bottom portion, and the back panel 3 at the rear portion are in common use, which improves the versatility of the parts and processing efficiency, while reducing the cost for molding.

The catches 221 of the top sub-panel 23 and the bottom sub-panel 24 are designed to be plugged up and down and can be rotated 360° for mounting, hence the versatility of the parts is improved, and the assembling process is more convenient.

The first sub-panel 21 in the middle is provided with a collar 211 at an upper end; to be mounted, the upper end is firstly inserted into the top panel 2, and then a lower end is rotated and pushed towards the body of the unit; in the assembling process, the first sub-panel 21 is supported on the bottom sub-panel 24 at an upper end thereof by gravity, and an operator can conveniently screw up the fastener without holding by hand.

In addition, the sides of each sub-panel 20 are designed to bend obliquely (i.e., the flaps 202), allowing for a hidden design of fastening screws when viewed from the front, hence the aesthetic appeal of the unit is improved.

Therefore, the air-conditioner outdoor unit 200 of the air-conditioning apparatus according to the present embodiment has the following advantages:

(1) fewer parts need to be disassembled for maintenance, so the maintenance is more efficient;

(2) the parts have higher versatility and are easy to be mounted, which increases the production efficiency while reducing the cost of molding;

(3) the fixing screws of the panel 2 feature a hidden design to improve the aesthetic appeal of the whole unit.

Figure 8:
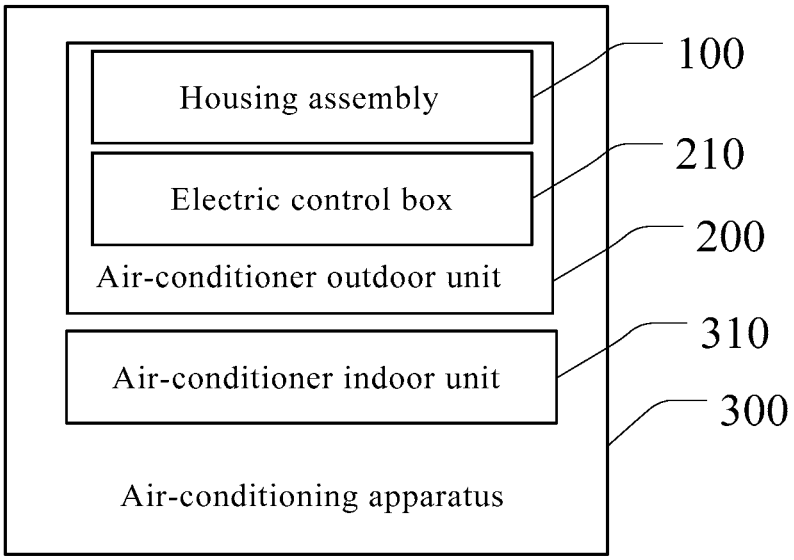
FIG. 8 is a block diagram of an air-conditioning apparatus according to an embodiment of the present disclosure.

As shown in FIG. 8, an embodiment of a third aspect of the present disclosure provides an air-conditioning apparatus 300, including an air-conditioner indoor unit 310, and an air-conditioner outdoor unit 200 as provided in the embodiment of the second aspect. The air-conditioner outdoor unit 200 is connected to the air-conditioner indoor unit 310.

Since the air-conditioning apparatus 300 according to the third aspect of the present disclosure includes the air-conditioner outdoor unit 200 according to the second aspect of the present disclosure, it is only necessary to remove the first sub-panel 21 to expose the electric control box 210 and repair the electric control box 210, without the need to remove two panels to expose the electric control box 210 as in the prior art. Therefore, the electric control maintenance is less difficult and facilitated. Moreover, the air-conditioning apparatus 300 has all the advantages of any of the above-described embodiments, which will not be described in detail herein.

In summary, the present disclosure provides a housing assembly, an air-conditioner outdoor unit, and air-conditioning apparatus, wherein the housing assembly includes a panel, and the panel includes a first sub-panel; since the first sub-panel is adapted to the electric control box of the air-conditioner outdoor unit, it is only necessary to remove the first sub-panel to expose the electric control box and repair the electric control box, without the need to remove two panels to expose the electric control box as in the prior art. Therefore, the electric control maintenance is less difficult and facilitated. In addition, compared with providing a large-area panel to shield the electric control box and other components, the solution herein of separately providing the first sub-panel adapted to the electric control box at a position corresponding to the electric control box is advantageous in reducing the size of the first sub-panel, thereby reducing the weight of the first sub-panel. Moreover, an operator is facilitated in disassembling and mounting the first sub-panel for the electric control maintenance. Therefore, the electric control maintenance is much less difficult and further facilitated.

In this application, the terms like "first", "second", and "third" are used for descriptive purposes only and are not to be construed as indicating or implying relative importance; the term like "plurality" refers to two or more unless explicitly defined otherwise. The terms like "mounted", "connected", "coupled", and "fixed" are to be construed broadly, for example, being "connected" may be a fixed connection, detachable connection, or integral connection; being "coupled" can be either directly or indirectly through an intermediary. For a person of ordinary skill in the art, the specific meaning of the above terms in the present disclosure can be understood according to specific situations.

In the description of the present disclosure, it is to be understood that the terms like "upper", "lower", "left", "right", "front", "back", and the like indicate orientations or positional relationships based on the orientation or positional relationships shown in the drawings, merely for convenience in describing and simplifying the present disclosure, not intended to indicate or imply that the referenced devices or units must have a particular orientation or be constructed and operated in a particular orientation. Therefore, these terms are not to be construed as limiting the present disclosure.

In the description of this specification, references to "an embodiment", "some embodiments", "particular embodiments", and the like, mean that a particular feature, structure, material, or characteristic described in connection with the embodiment or example is included in at least one embodiment or example of the present disclosure. Herein, representations of the above terms do not necessarily refer to the same embodiment or example. Furthermore, the particular features, structures, materials, or characteristics described may be combined in any suitable manner in any one or more embodiments or examples.

What is claimed is:

1. A housing assembly for an air-conditioner outdoor unit, comprising:

a panel, the panel including a plurality of sub-panels, the plurality of sub-panels including a first sub-panel, an upper second sub-panel, and a lower second sub-panel, the first sub-panel being adapted to an electric control box of the air-conditioner outdoor unit for shielding the electric control box, wherein two sides of the first sub-panel along a height of the air-conditioner outdoor unit are respectively provided with the upper second sub-panel and the lower second sub-panel the upper second sub-panel is a top sub-panel that is above and adjacent a side of the first sub-panel, the lower second sub-panel is a bottom sub-panel that is below and adjacent a bottom side of the first sub-panel, each sub-panel of the plurality of sub-panels includes a panel body and a flap, each flap is connected to the panel body at an end, and each flap is provided with an avoidance space, wherein the avoidance space is oriented relative to an end edge of the panel body and faces a middle of the panel body in a recessed setting, and wherein the plurality of sub-panels have multiple avoidance spaces that are in communication, the avoidance space of the upper second sub-panel is connected upwards through to a top surface of the housing assembly, and the avoidance space of the lower second sub-panel is connected downwards through to a bottom surface of the housing assembly.

2. The housing assembly according to claim 1, wherein the housing assembly comprises a shell that is provided with a catch and a plughole, and the catch comprises:

a connecting portion connected to the upper second sub-panel, the lower second sub-panel, or the shell;

a first hooking portion bent from and connected to the connecting portion and passing through the plughole; and a second hooking portion bent from and connected to the connecting portion and passing through the plughole, the second hooking portion being bent in a direction opposite the first hooking portion.

3. The housing assembly according to claim 2, wherein the first hooking portion and the second hooking portion are structurally the same, and the first hooking portion and the second hooking portion are arranged mirror symmetrically on both sides of the connecting portion.

4. The housing assembly according to claim 2, wherein a mounting cavity is provided in the shell, the mounting cavity has an open end, the open end of the mounting cavity includes a first opening and a second opening, the first opening corresponds to the electric control box, and the upper second sub-panel or the lower second sub-panel is adapted to the second opening;

the upper second sub-panel and the lower second sub-panel each have a one-to-one correspondence to the second opening; and the first sub-panel and the top sub-panel are arranged along a height of the shell, and a bottom side of the first sub-panel is provided with the lower second sub-panel.

5. The housing assembly according to claim 4, wherein the mounting cavity is provided with a third opening opposite the open end of the mounting cavity, and the housing assembly further comprising:

a back panel detachably connected to the shell for opening or closing the third opening.

6. The housing assembly according to claim 5, wherein the back panel is structurally identical to the upper second sub-panel.

7. The housing assembly according to claim 1, wherein the first sub-panel is provided with a collar and the collar is in a clearance fit with a slot provided at a bottom of the upper second sub-panel so that the first sub-panel is adapted to rotate relative to a shell of the housing assembly;

the lower second sub-panel has a top and a bottom, and the top of the lower second sub-panel is configured to support and engage the bottom of the first sub-panel.

8. The housing assembly according to claim 1, wherein at least one flap of the first sub-panel, the upper second sub-panel or the lower second sub-panel comprises:

is provided with a connecting hole for mounting a fastener.

9. The housing assembly according to claim 8, wherein the housing assembly includes the fastener, and the at least one flap is connected to a shell of the housing assembly through the fastener.

10. The housing assembly of claim 9, wherein the at least one flap comprises:

a first connecting flap, one end of the first connecting flap being connected to the end portion of the panel body, and the other end of the first connecting flap being configured to be oblique towards the middle of the panel body; and a second connecting flap, the second connecting flap being bent from and connected to the other end of the first connecting flap and configured to be oblique away from the middle of the panel body, wherein the second connecting flap and the first connecting flap enclose the avoidance space, the second connecting flap is connected to the shell through the fastener, and a top of the fastener is located in the avoidance space of the at least one flap.

11. The housing assembly according to claim 1, wherein: each flap comprises:

a first connecting flap, one end of the first connecting flap being connected to the end portion of the panel body, and the other end of the first connecting flap being configured to be oriented obliquely towards the middle of the panel body; and a second connecting flap, the second connecting flap being bent from and connected to the other end of the first connecting flap and configured to be oriented obliquely away from the middle of the panel body, wherein the second connecting flap and the first connecting flap enclose the avoidance space, the second connecting flap is connected to a shell of the housing assembly through a fastener, and a top of the fastener is located in the avoidance space, and the shell comprises:

a side panel and a bent edge, the bent edge being parallel to the second connecting flap, wherein the bent edge has a rear extension portion that connects a rear edge of the bent edge to the side panel, and the rear extension portion is angled from back to front toward the middle of the panel body, a front extension portion extends from the bent edge and the front extension portion defines a front edge of the shell, wherein a connection portion of the first connecting flap and second connecting flap is located at a rear side of the front edge of the shell while the second connecting flap is connected to bent edge through the fastener.

12. The air-conditioner outdoor unit, comprising:

the housing assembly according to claim 1; and the electric control box, wherein the electric control box is arranged corresponding to the first sub-panel of the housing assembly and is shielded by the first sub-panel.

13. An air-conditioning apparatus, comprising:

an air-conditioner indoor unit; and the air-conditioner outdoor unit according to claim 12, wherein the air-conditioner outdoor unit is connected to the air-conditioner indoor unit.

* * * * *